US005711264A

United States Patent [19]

Jezek et al.

[11] Patent Number: 5,711,264

[45] Date of Patent: Jan. 27, 1998

[54] COMBUSTION ENGINE COMPRESSION RELEASE MECHANISM

[75] Inventors: Jaroslav Jezek; Josef Jarosik; Emanuel Wertheim, all of Ceske Budejovice, Czech Rep.

[73] Assignee: Motor Jikov a.s., Ceske Budejovice, Czech Rep.

[21] Appl. No.: 824,298

[22] Filed: Mar. 26, 1997

[30] Foreign Application Priority Data

Apr. 9, 1996 [CZ] Czech Rep. ..... 1029-96

[51] Int. Cl.[6] ..... F01L 13/08

[52] U.S. Cl. ..... 123/182.1

[58] Field of Search ..... 123/182.1, 90.16

[56] References Cited

U.S. PATENT DOCUMENTS

| | | | |
|---|---|---|---|
| 4,672,930 | 6/1987 | Sumi | 123/182.1 |
| 4,696,266 | 9/1987 | Harada | 123/182.1 |
| 4,892,068 | 1/1990 | Coughlin | 123/182.1 |
| 4,898,133 | 2/1990 | Bader | 123/182.1 |
| 4,991,551 | 2/1991 | Terai et al. | 123/182.1 |
| 5,085,184 | 2/1992 | Yamada et al. | 123/182.1 |
| 5,184,586 | 2/1993 | Bucholz | 123/182.1 |
| 5,197,422 | 3/1993 | Olesky et al. | 123/182.1 |
| 5,317,999 | 6/1994 | Kern et al. | 123/182.1 |

FOREIGN PATENT DOCUMENTS

| | | | |
|---|---|---|---|
| 6-74012 | 3/1994 | Japan | 123/182.1 |

*Primary Examiner*—Erick R. Solis
*Attorney, Agent, or Firm*—Notaro & Michalos PC

[57] ABSTRACT

A combustion engine compression release mechanism having a cam shaft with a cam operating an exhaust valve lifter and a cam shank operating the same exhaust valve lifter independently of the cam during the starting speed of the engine in order to release the compression within the engine cylinder. The cam shank is mounted on the cam shaft for rotatable motion and has a cam portion to engage the exhaust valve lifter during the low starting speed of the engine. A rocker arm is attached to the cam shank to extend radially from the cam shank and is provided by a guide. A slide block is mounted in the guide for motion along the guide and is fixed to an eccentric body adapted to move by effect of centrifugal force with relation to the cam shaft and to operate the slide block. The eccentric body is urged by a spring into a position where the cam portion of the cam shank engages the exhaust valve lifter.

3 Claims, 1 Drawing Sheet

COMBUSTION ENGINE COMPRESSION RELEASE MECHANISM

BACKGROUND OF THE INVENTION

The present invention relates to a Combustion engine compression release mechanism having a cam shaft with a cam operating an exhaust valve lifter and a cam shank operating the same exhaust valve lifter independently of the cam during the starting speed of the engine to release the compression within the engine cylinder. The cam shank is driven by a eccentric body pivotally mounted on a cam shaft element dependent on the engine speed.

DESCRIPTION OF THE PRIOR ART

A compression release mechanism is used preferably with small engines where the starting operation is accomplished by operator's hand or leg as the case may be and therefore in the first stage before the combustion mixture has been ignited and the engine starts to run it is necessary to reduce the forces to be applied to overcome the air or combustion mixture compression in the cylinder. The release action is effected mechanically by means adapted to lift the stem of the exhaust valve when the engine rests and during the initial phase of starting of the engine. The original manual operation of the mechanism by hand commonly effected through a so called "bowden" cable has been later replaced by automatic operation means out of which a simplest and most popular mechanism proved to be a mechanical apparatus making use of centrifugal forces derived from a motion of a body mounted eccentrically on an element of the cam shaft. Thus the body operates the mechanism for lifting the exhaust valve stem. The fact that the body is eccentrically pivotally mounted on the cam shaft element ensures that its movement caused by centrifugal force is effected not only in a radial direction with respect to the axis of rotation of the cam shaft element on which it is mounted but also in a tangential orientation. The range of the movement of the eccentric body caused by centrifugal forces generated by rotation of the cam shaft is limited by appropriate abuts to certain degree of rotation.

One of the known mechanism of the latest prior art is described in U.S. Pat. No. 4,898,133. The mechanism causing movement of the exhaust valve independently of the regular cam consists of a rotatable cam pin mounted for rotatable motion on the cam shaft while a portion of the cam pin engaging the exhaust valve is shaped in a manner that in certain rotation position it pushes the exhaust valve lifter to open the valve. The cam pin is operated by a drive pin whose swinging motion is derived from the motion of the above described eccentrically mounted body in such a manner that the driving pin projects through an aperture provided in the eccentric body. The boundary positions of the drive pin and also of the cam pin are defined by stops against which the driving pin abuts and which are fixed on a cam shaft gear. This mechanism is reliable in operation nevertheless includes a number of elements and the motion of the drive pin within the eccentric body aperture produces shocks and additional noise at the start of the engine when the speed fluctuates and the compression release operation is repeated.

SUMMARY OF THE INVENTION

A compression release mechanism comprises a cam shaft and a compression release cam shank which operates a valve to release pressure within the engine cylinder. The cam shank is provided at its one end by a rocker arm with an internal guide whose in which a slide block is inserted. The slide block is fixed to a rotatably mounted eccentric body whose axis of rotation is offset with respect to the axis of rotation of the cam shaft and which is urged by a spring to one of the extreme position of the eccentric body. The eccentric body is preferably rotatably mounted on a cam shaft gear for driving the cam shaft.

The two extreme position of the slide block within the rocker arm guide are defined in such a manner that in one extreme position the eccentric body abuts the cam shaft and in the opposed extreme position the slide block engages the upper end of the rocker arm guide.

An advantage of the compression release mechanism consists in a more simple construction characterized by minimum constructional elements and minimum space to be occupied therewith. This results in reduction of production costs and in more effective utilization of the available space.

Another advantage is the reduction of the amount of noise produced upon striking the stop means by the mechanism parts during the compression release phase accompanied by the engine speed fluctuation. As compared with the previous mechanism the stop means are reduced to a minimum number of two.

BRIEF DESCRIPTION OF THE DRAWINGS

The accompanying drawings illustrate schematically one of the possible embodiments of the invention which is considered as a preferred embodiment. In the drawings.

DESCRIPTION OF THE PREFERRED EMBODIMENT

Figure 1:
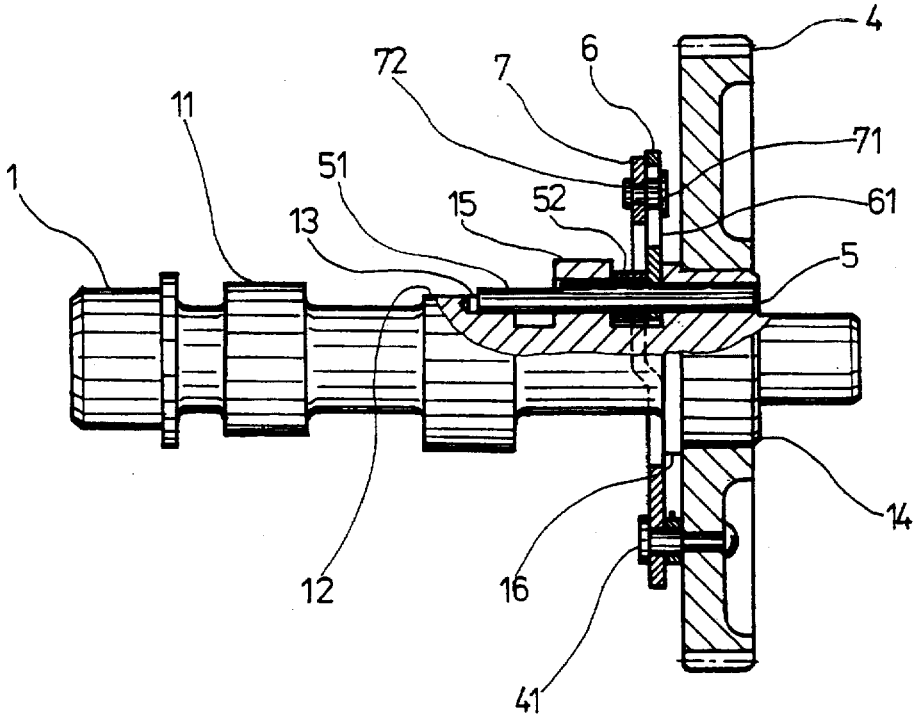
FIG. 1 is a partial sectional elevation view of a compression release mechanism

The engine cam shaft 1 is provided by two cams 11, 12 and is driven by a gear 4 fixed on a journal 14 provided by a shoulder 16. The cam 11 engages a lifter of a conventional engine intake valve which is not shown and the cam 12 engages a lifter of a conventional engine exhaust valve, also not shown. A cam shank 5 is rotatable mounted on the cam shaft 1 so that one end of the cam shank is received in an opening provided in the journal 14 and its another sector is supported by a seat provided in a lobe 15 of the cam shaft 1. The opposite end of the cam shank is inserted in a groove 13 of the cam 12 and comprises a cam portion 51 of irregular non cylindrical cross section so that in a certain angle range of rotation the cam portion extends above the adjacent surface of the cam 12 and engages the valve lifter. A rocker arm 6 extending outwardly is attached to the cam shank 5. A spacer sleeve 52 is inserted into the space between the rocker arm 6 and the lobe 15 to hold the rocker arm close to a shoulder 16 of the journal 14. The rocker arm is provided by a guide 61 which receives a slide block 71 mounted on a pivot 72 fixed to an eccentric body 7. The eccentric body 7 is mounted for swinging motion on a pivot 41 attached to a gear 4. The eccentric body 7 is coupled with a spring 8 which urges the eccentric body with its internal edge into the contact with the surface of the cam shaft 1.

Figure 2:
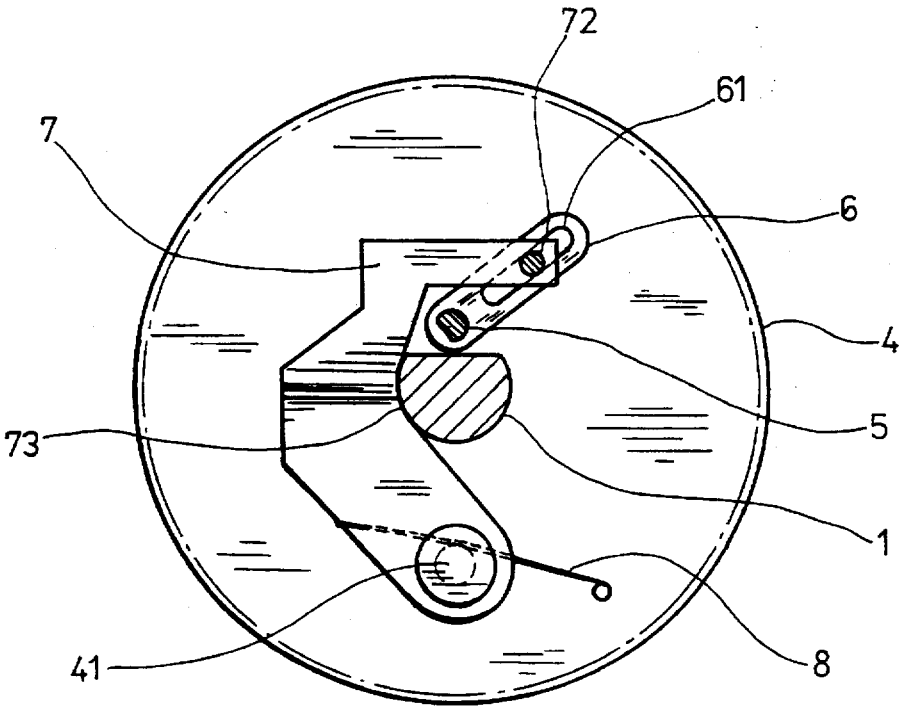
FIG. 2 is a sectional side view of the same compression release mechanism along a vertical plane passing parallel to the surface of an eccentric body.

The operation of the mechanism is initiated by centrifugal force produced by rotation of the gear 4 which effects the eccentric body 7 in order to rotate on the pivot 41. Due to the fact that the eccentric body is mounted on a pivot 41 which is offset with respect to the axis of rotation of the gear 4 the centrifugal force urges the eccentric body to move radially outwards to overcome the biased force of the spring 8. If the engine is in rest or rotates at a low speed the gear 4 and the cam shaft 1 namely during the starting of the engine the biased force of the spring 8 urges the eccentric body into contact with the cam shaft cannot be overcome due to a relatively minor centrifugal force. In this position of the eccentric body the slide block 71 takes its lower position within the guide 61 of the rocker arm 6. In this position of the rocker arm 6 which defines also the position of the cam shank 51 to which it is fixed the cam portion 51 of the cam shank extends above the adjacent surface of the cam 13 and engages the exhaust valve lifter (not shown) to open the exhaust valve and to release the compression pressure within the engine cylinder in order to enable easy starting of the engine. Following the starting of the engine the speed of the engine as well as that of the cam shaft is increased what is accompanied by increase on centrifugal force effecting the eccentric body 7. As a result, the eccentric body moves in radial outward direction and brings the slide block 72 within the guide 61 to its upper position until it matches the upper circular edge portion of the guide 61. This motion is accompanied by a motion of the rocker arm to its left extreme position opposite to its right position as shown in FIG. 2. The corresponding rotation of the cam shank 5 brings its cam portion 51 in a position where the cam portion ceases to engage the exhaust valve lifter which comes again into contact with the cam 13 so that the valve lifter is operated only by the cam 13. In the course of the starting maneuver so called kickbacks or speed fluctuation cannot be absolutely avoided so that the described procedure may be automatically repeated until the engine achieves its minimum regular speed.

The combustion engine compression release mechanism is suitable for use especially with small engines with a valve gear the starting of which is effected manually or by leg and the necessary starting force is to be limited to a reasonable extend acceptable by the operator. The engines may be mobile or stable and designed for various mechanization devices such as compressors, mowing machines small motorcycles, mopeds etc.

We claim:

1. A combustion engine compression release mechanism having a cam shaft provided by a cam operating an exhaust valve lifter and a cam shank operating the same exhaust valve lifter independently of the cam during the starting speed of the engine to release the compression within the engine cylinder comprising a cam shank mounted on the cam shaft for rotatable motion and having a cam portion for engaging the exhaust valve lifter during the low starting speed of the engine, a rocker arm extending radially from the cam shank and provided by a guide having an upper and a lower end, a slide block mounted in the guide for motion along the guide and fixed to an eccentric body adapted to move by effect of centrifugal force with relation to the cam shaft and to operate the slide block, means urging the eccentric body and the cam shank in a position where the cam portion of the cam shank engages the exhaust valve lifter.

2. The mechanism according to claim 1 wherein the eccentric body is pivotally mounted on the cam shaft gear in a position that it is offset with respect to the axis of rotation of the cam shaft.

3. The mechanism according to claim 1 wherein in one angular extreme positions of the swinging eccentric body when the cam portion of the cam shank engages the exhaust valve lifter the eccentric body is in contact with the cam shaft and in the other angular extreme position of the eccentric body when the cam portion of the cam shank disengages the exhaust valve lifter the slide block is in contact with the upper end of the guide.

* * * * *